US005493842A

United States Patent [19]

Concetti

[11] Patent Number: 5,493,842

[45] Date of Patent: Feb. 27, 1996

[54] APPARATUS FOR THE FORMATION AND APPLICATION OF A SEALING FLAP TO SEAL THE MOUTH OF A FILLED SACK, STARTING FROM A CONTINUOUS STRIP OF HEAT-SEALABLE MATERIAL

[75] Inventor: Teodoro Concetti, Bastia Umbra, Italy

[73] Assignee: Concetti S.p.A., Bastia Umbra PG, Italy

[21] Appl. No.: 271,989

[22] Filed: Jul. 8, 1994

[30] Foreign Application Priority Data

Jul. 13, 1993 [IT] Italy ..... RM93A0463

[51] Int. Cl.[6] ..... B65B 61/00

[52] U.S. Cl. ..... 53/135.1; 53/136.1; 53/136.5

[58] Field of Search ..... 53/75, 136.3, 138.1, 53/136.1, 136.5, 135.1, 135.2, 135.3; 493/210, 212, 214, 226, 379, 383

[56] References Cited

U.S. PATENT DOCUMENTS

| | | | |
|---|---|---|---|
| 2,749,966 | 6/1956 | Roetger . | |
| 2,987,858 | 6/1961 | Kerker | 53/415 |
| 3,369,950 | 2/1968 | Rosewicz et al. | 493/212 |
| 3,439,468 | 4/1969 | Bok | 53/415 |
| 3,782,069 | 1/1974 | Fischbein et al. . | |
| 3,894,380 | 7/1975 | Poulsen | 53/75 |
| 3,955,481 | 5/1976 | Heitmann | 53/135.2 |
| 4,282,055 | 8/1981 | Bosse et al. | 53/136.3 |
| 4,426,035 | 1/1984 | Dieckow | 493/212 |
| 4,567,711 | 2/1986 | Hodnett et al. . | |

FOREIGN PATENT DOCUMENTS

| | | |
|---|---|---|
| 1161723 | 8/1969 | United Kingdom . |
| 1245154 | 12/1971 | United Kingdom . |

*Primary Examiner*—John Sipos
*Assistant Examiner*—Ed Tolan
*Attorney, Agent, or Firm*—Browdy and Neimark

[57] ABSTRACT

An apparatus for forming and applying a sealing flap to seal the mouth of a filled sack, starting from a continuous strip (9) of heat-sealable material includes a first loop conveyor to unwind the strip from the feeder roll and transfer it, using clamp means (10, 11, 12, 13) and guide means (14), to a second loop conveyor (15), likewise provided with clamp means (21, 22, 23, 24) to hold the strip (9). Between the first and the second conveyor (1, 15) cutting means (28, 29) are provided to cut the strip (9) when the section of the latter transferred to the second conveyor (15) has reached a pre-set length corresponding to the width of the sack (31) to be sealed. The second conveyor is associated with a shaping device (26) which, during advance of the strip (9), folds the strip itself until it is substantially in the shape of an upside down U, thus forming the sealing flap (32). The second conveyor (15) moves between a first upturned position around the end adjacent to the first conveyor (1), corresponding to the formation stage of said sealing flap (32), and a horizontal position, corresponding to the positioning stage of the sealing flap (32) over the mouth of the sack (31) to be closed ready for subsequent sealing. (FIG. 1)

4 Claims, 2 Drawing Sheets

APPARATUS FOR THE FORMATION AND APPLICATION OF A SEALING FLAP TO SEAL THE MOUTH OF A FILLED SACK, STARTING FROM A CONTINUOUS STRIP OF HEAT-SEALABLE MATERIAL

BACKGROUND OF THE INVENTION

1. Field of the Invention

The present invention relates to an apparatus for the formation and application of a sealing strip to seal the mouth of a filled sack, starting from a continuous strip of heat-sealable material.

2. Description of the Prior Art

At the present time, various systems exist for closing filled sacks made of heat-sealable material, in particular in sack filling machines.

Among these, the most simple and widely used involves heat sealing of the edges of the sack mouth, generally using a special device with heated bars, which seal the mouth of the sack together between them.

However, if the sack is filled with certain powdery or adhesive materials, the material with which the sack is filled is deposited on the inner surfaces of the sack itself, including the inner surfaces of the mouth, so that the above mentioned sealing operation becomes difficult or impossible.

In order to solve the problem mentioned above, a length of a strip of sheet material is used, generally the same material used to form the sack, and this strip is folded over and sealed to the opposite outer surfaces of the mouth of the sack, so as to seal it.

The systems for performing this operation are many, and include the manual application of the strip, or mechanical devices which fold the strip and assemble it on the mouth of the sack.

Obviously, manual application of this sealing strip is extremely uneconomical, as it involves a notable waste of manpower and time. On the other hand, the mechanical devices employed up to now have not shown themselves to be suitable for the job involved, so that application of the sealing strip is incorrect, resulting in faulty sealing of the mouth of the sack in question, and consequent leakage of the material contained therein when moved.

SUMMARY OF THE INVENTION

The object of the present invention is to provide an apparatus for formation and application of a sealing flap to seal the mouth of a filled sack, starting from a continuous strip of heat-sealable material, capable of performing the operation in question in a surprisingly reliable and exact manner such as to guarantee perfect sealing of the sack, thus avoiding the problems found when using similar devices according to the prior art.

The apparatus according to the present invention substantially comprises a first loop conveyor to unroll the strip from a supply roll and to transfer it, with the aid of clamp means and guide means, to a second conveyor, also provided with clamp means to hold the strip. Between the first and the second conveyor cutting means are provided to cut the strip when the section of the latter transferred to the second conveyor has reached a pre-set length corresponding to the width of the sack to be sealed. The second conveyor is associated with a shaping device which, during advance of the strip, folds the strip itself until it is substantially in the shape of an upside down U, thus forming the sealing flap. The second conveyor moves between a first upturned position around the end adjacent to the first conveyor, corresponding to the formation stage of the sealing flap, and a horizontal position, corresponding to the positioning stage of the sealing flap over the mouth of the sack to be closed ready for subsequent sealing.

BRIEF DESCRIPTION OF THE DRAWINGS

The present invention will be more clearly illustrated hereinbelow, with reference to a preferred embodiment thereof, given merely as a non-limiting example, with reference to the enclosed drawings, in which.

DESCRIPTION OF THE PREFERRED EMBODIMENT

Figure 1:
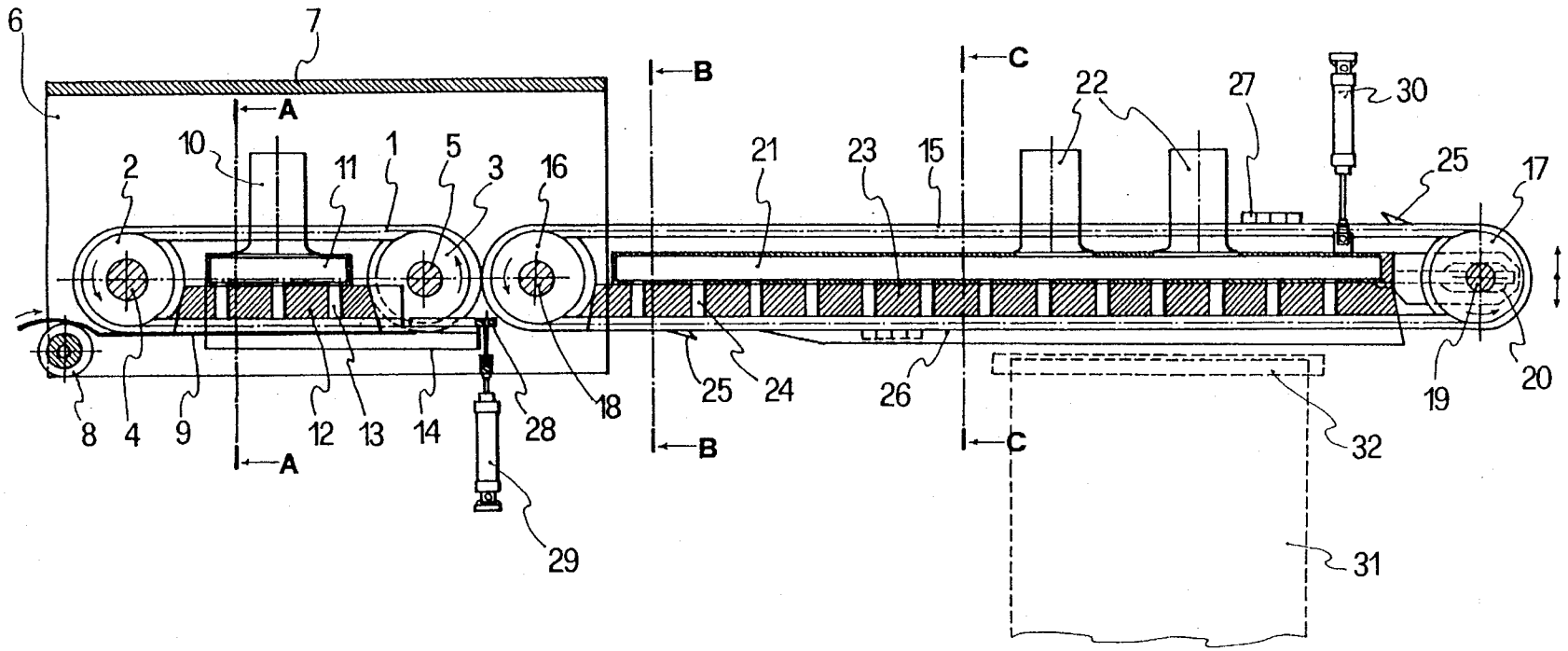
FIG. 1 is a side view, in partial cross-section, of the apparatus according to the invention.

With reference to FIG. 1, a first endless chain conveyor 1 is shown, mounted on a pair of sprocket wheels 2 and 3, one driving and the other driven respectively, fixed to respective rotation shafts 4 and 5, the ends of which are pivotally supported on respective bearings (not illustrated) fixed to vertical side plates 6, set opposite to one another, of which only one is illustrated, said plates being connected by an upper horizontal plate 7.

An idle roller 8, rotatably supported on a shaft whose ends are fixed to the vertical side plates 6, is arranged adjacent to the first end part of the first endless chain conveyor 1 in correspondence with the sprocket wheel 2, to guide a continuous strip 9 of heat-sealable sheet material. The strip is delivered from a feeder roll (not illustrated), along the lower section of the first chain conveyor 1 to which the strip is made to adhere by vacuum action generated by vacuum produced through a hood 10, connected to a vacuum source (not illustrated) in a plenum chamber 11. The ends of the chamber 11 are sealingly secured to the vertical side plates 6. The chamber 11 lies over a block 12, preferably of plastic material, provided with through holes 13. The upper ends of the holes are in communication with said chamber 11, whereas the lower ends onto the lower section of the first chain conveyor 1.

Figure 2:
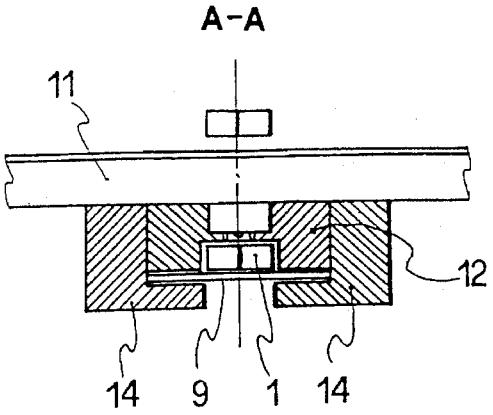
FIG. 2 is an enlarged cross-section view, taken along line A—A of FIG. 1.

As can be seen more clearly in FIG. 2, along one part of-said lower section of the first chain conveyor 1 the strip 9, as well as being held onto the latter by the vacuum action created by said vacuum, is also supported and guided by L-shaped blocks 14 extending longitudinally along opposite sides of said conveyor.

In order to receive from the first chain conveyor 1 a measured length of the strip 9 and shape it into a U and apply it to the mouth of the filled sack in question, as will be described in greater detail in the following, a second endless chain conveyor 15 is provided, supported on sprocket wheels 16 and 17, of which one is driving and the other driven. The first of the sprocket wheels is fixed to a rotation shaft 18 whose ends are pivotally supported by respective bearings (not illustrated) secured to the vertical side plates 6, whereas the second of the sprocket wheels is mounted on an idling shaft 19 supported by a chain tightening support 20.

A plenum chamber 21 extends longitudinally in a fixed position between the upper and lower sections of the second chain conveyor 15. Vacuum is produced in this chamber by means of hoods 22 connected to a vacuum source (not illustrated). The chamber 21 lies over a longitudinal block 23, preferably of plastic material, provided with numerous through holes 24. The upper ends of the holes are in communication with said chamber 25, whereas the lower ends open onto the lower section of the second chain conveyor 15.

Figure 3:
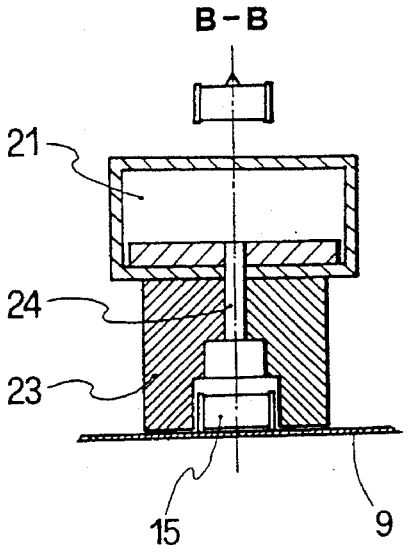
FIG. 3 is an enlarged cross-section view, taken along line B—B of FIG. 1.
Figure 4:
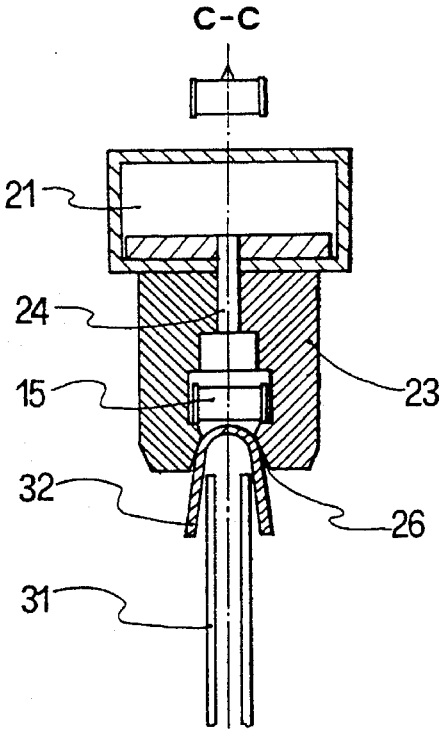
FIG. 4 is an enlarged cross-section view, taken along line C—C of FIG. 1.

As in the case of the first chain conveyor 1, the vacuum in the pipe 23, as can be seen from FIG. 3, serves to create suction through the through holes 24 in the longitudinal block 23, to hold the strip 9 against the lower section of the second chain conveyor 15 and to move it, in this case by means of a plurality of hooks, only two of which are illustrated and indicated with 25, provided on the chain of the second conveyor.

To fold the length of strip 9, transferred from the first chain conveyor to the second chain conveyor, into the desired shape of an upside down U in order to form the sealing flap to be applied to the mouth of a sack, an upside down forming channel 26 is provided in the lower fixed surface of the longitudinal block 23, starting from a certain distance from the end of the second chain conveyor 15 adjacent to the first chain conveyor 1. The channel 26 gives the strip its desired shape as the strip 6 advances, driven by the chain of the second conveyor 15.

The second chain conveyor 15 is furthermore provided with position sensors 27 which, during movement of the conveyor itself, energize and de-energize a pair of electric elements (not illustrated) which drive said conveyor to the correct starting position to start a new cycle at the end of each preceding cycle.

A cutting device 28 is arranged between the first and the second chain conveyor 1 and 15. This device, activated by a hydraulic actuator 29, cuts the strip 9 to the correct length, thus defining the length of strip on the second chain conveyor 15 used to form said sealing flap.

The free end of the rod of the piston in a hydraulic actuator 30 is connected to the upper end portion of the second chain conveyor 15 opposite that adjacent to the first chain conveyor 1. In this way the second conveyor 15 can rotate around its rotation shaft 18 between an upwardly inclined position, which corresponds to the sealing flap formation stage and is provided so as not to interfere with translation of the sack to be sealed from the filling station to the station in which said sealing flap is applied, and a horizontal position, shown in FIG. 1, which corresponds to the stage during which the shaped sealing flap 32 is applied to the mouth of an underlying full sack 31.

In operation, with both the first and the second chain conveyor 1 and 15 in movement by rotation of the respective sprocket wheels and with the second chain conveyor 15 in the upwardly inclined position, the web of strip material 9, coming from the feeder roll (not illustrated), is guided, by means of the idle roller 8, onto the first chain conveyor 1. The web adheres to the lower section of the chain conveyor by means of the suction created through holes 13 in block 12 by the vacuum in the plenum chamber 11, and is made to advance, likewise supported by the L-shaped guide blocks 14, towards the second chain conveyor 15 until it is passed onto the lower section of the latter. On this lower section, the strip is gripped by one of the numerous hooks 25, while at the same time being made to adhere to the chain of the second conveyor 15 by the suction action created through the holes 24 in the block 23 by the vacuum in the plenum chamber 21. When a length of strip 9 of substantially the same length as the width of the mouth of the sack to be sealed has been transferred onto the second chain conveyor 15, the hydraulic actuator 29 activating the cutting device 28, which is formed, for example, by a blade, comes into action to cut the strip 9. The cut length of strip 9 on the second chain conveyor 15 proceeds to advance along the forming channel 26 on the lower surface of the fixed block 23 until it has been folded from a flat condition into the shape of an upside down U (sealing flap). When formation of this sealing flap has been completed, movement of the chain conveyors is stopped and the hydraulic actuator 30 comes into operation. By extending its piston shaft, the hydraulic actuator causes the second chain conveyor 15 to rotate in a clockwise direction around the shaft 18 bearing the sprocket wheel 16, and lowers said conveyor from the inclined position to the horizontal position, as shown in FIG. 1. In this way the sealing strip 32 is applied to the mouth of the sack 31, coming from the filling station, by interruption of the vacuum in the chamber 21, and is ready for the subsequent sealing operation. Then, the second chain conveyor 15, by means of the position sensors 27 and relative associated electric elements, is returned to the correct starting position ready to start another cycle.

The present invention is not limited to the embodiment described, but comprises any variation thereof.

I claim:

1. An apparatus for cutting to measure and forming a sealing flap of heat sealable material from a continuous strip of said material and conveying said flap onto the mouth of a filled sack for a heat-sealing thereof, comprising:

a first endless chain conveyor having a lower section in which longitudinally extending blocks are provided to support and guide said strip along the longitudinal direction thereof, said blocks being provided with through holes;

opposed vertical side plates pivotally supporting said first chain conveyor;

a first plenum chamber sealingly secured to said plates and placed over said blocks in communication with said holes to hold said strip supported and guided on said blocks by action of suction vacuum created in said plenum chamber and in said holes of the blocks;

a second endless chain conveyor pivotally mounted at one end thereof on said plates and having an idle sprocket wheel at the other end, said second conveyor being adjacent to said first conveyor in said longitudinal direction thereof and being rotatable with respect to said side plates from a position horizontally aligned with said first conveyor to an upwardly inclined position;

a cutting device between said first and second conveyor to cut said strip in a correct length measure for forming said flap, said second conveyor transporting said flap along the lower section thereof;

longitudinally extending blocks and a second plenum chamber placed over said blocks mounted in a fixed position between said ends of said second conveyor, said blocks being provided with holes in communication with said plenum chamber to hold said flap supported and guided on said blocks by action of suction vacuum created in said plenum chamber and in said holes of the blocks;

said fixed blocks in said second conveyor being formed with an upside down forming channel on the lower surface thereof to give said flap a desired upside down U shape as said flap advances along said second conveyor; and actuating means to produce rotation of said second conveyor from said horizontal to said inclined position during the stage in which said flap is formed and a filled sack is translated from a filling station to a sealing station and rotation from said inclined to said horizontal position to apply said formed flap to the mouth of the sack by interruption of suction in the plenum chamber of said second conveyor.

2. An apparatus according to claim 1, in which said first and second conveyor are endless chain conveyors mounted on respective sprocket wheels, of which one is a driving wheel and the other a driven wheel, capable of rotating around respective shafts.

3. An apparatus according to claim 1, in which said second conveyor further comprises, as additional means for holding the strip, a number of spaced hooks.

4. An apparatus according to claim 1, in which said cutting means are a blade activated by a hydraulic actuator.

* * * * *